United States Patent [19]

Abinanti

[11] Patent Number: 4,932,539

[45] Date of Patent: Jun. 12, 1990

[54] DISPLAY FRAMEWORK CONSTRUCTION

[75] Inventor: Sharon M. Abinanti, Rolling Meadows, Ill.

[73] Assignee: Met Display & Fixture, Inc., Chicago, Ill.

[21] Appl. No.: 364,522

[22] Filed: Jun. 9, 1989

Related U.S. Application Data

[63] Continuation of Ser. No. 174,214, Mar. 28, 1988, abandoned.

[51] Int. Cl.[5] ..... A47H 1/00

[52] U.S. Cl. ..... 211/123; 211/205

[58] Field of Search ..... 211/123, 205, 192, 196, 211/204, 182, 187, 193, 207, 208, 190

[56] References Cited

U.S. PATENT DOCUMENTS

| | | | |
|---|---|---|---|
| 3,612,287 | 10/1971 | Maltese | 211/182 X |
| 3,724,678 | 4/1973 | Challier | 211/182 X |
| 3,791,091 | 2/1974 | Albrizzi | 211/182 X |
| 4,351,441 | 9/1982 | Schramm | 211/207 |
| 4,474,316 | 10/1984 | Philibert | 211/123 X |
| 4,655,354 | 4/1987 | Cohen | 211/207 X |

FOREIGN PATENT DOCUMENTS

| | | | |
|---|---|---|---|
| 42393 | 6/1930 | Denmark | 211/189 |
| 2019457 | 11/1971 | Fed. Rep. of Germany | 211/205 |
| 250623 | 11/1966 | Netherlands | 211/182 |
| 906725 | 9/1962 | United Kingdom | 211/189 |

*Primary Examiner*—J. Franklin Foss
*Assistant Examiner*—Sarah A. Lechok
*Attorney, Agent, or Firm*—Thomas R. Vigil

[57] ABSTRACT

The display framework construction comprises at least one column including a base and an elongate upwardly extending column assembly including four generally cylindrical elongate members. Each generally cylindrical member is located at a corner of the column assembly. The column assembly further includes an interior elongate tubular member having a generally +-shaped cross-section with four narrow elongate walls interconnected by four elongate walls each having an arcuate, concave cross-section. Each narrow elongate wall has a plurality of vertically spaced apart slots therein for receiving hooks on brackets for creating different display framework constructions. The brackets are provided at one or both ends of an arm assembly comprising an upper generally cylindrical elongate member and a lower generally cylindrical elongate member fixed in a position juxtaposed to the upper generally cylindrical elongate member.

23 Claims, 7 Drawing Sheets

DISPLAY FRAMEWORK CONSTRUCTION

This is a continuation of application Ser. No. 174,214, filed Mar. 28, 1988, now abandoned.

BACKGROUND OF THE INVENTION

1. Field of the Invention

The present invention relates to a display framework construction which includes a unique modular design in the form of generally cylindrical elongate members or bars. The display framework includes one or more columns each including at least four generally cylindrical, elongate corner members so as to present two elongate cylindrical members on each side of each column.

Each embodiment of the display framework construction includes at least one arm assembly and each arm assembly includes an upper and lower elongate generally cylindrical bar or tube for strength and for carrying through a display framework assembly the appearance of two adjacent cylindrical members.

2. Description of the Prior Art

Heretofore various types of display racks have been proposed which include one or more upright column members mounted on a base and having arms extending therefrom for supporting hangers on which are displayed items of wearing apparel. Such display framework constructions are in wide use today in clothing stores and department stores for displaying wearing apparel for sale.

The display framework construction of the present invention differs from the previously proposed display frameworks by providing modular components for the display framework construction including columns and arm assemblies which include at least two generally cylindrical elongate members in the form of rods or tubes which provide not only strength of construction but also an attractive aesthetic design.

As will be described in greater detail hereinafter, the display framework construction of the present invention includes at least one upright column which includes a base on which is mounted a column assembly including four generally cylindrical elongate corner members and a central or internal tubular member having a +−shaped cross-section defined by four narrow elongate walls interconnected by four elongate concave-in-cross-section walls against which the generally cylindrical members are received and fixed.

SUMMARY OF THE INVENTION

According to the present invention there is provided a display framework construction comprising at least one column including a base and an elongate upwardly extending column assembly including four generally cylindrical elongate members, each generally cylindrical member being located at a corner of the column assembly and a central elongate tubular member having a generally +-shaped cross-section with four narrow elongate walls interconnected by four elongate walls each having an arcuate concave cross-section. Preferably, each narrow elongate wall has a plurality of vertically spaced apart slots therein for receiving hooks on brackets for creating different display framework constructions. The brackets are provided at one or both ends of an arm assembly comprising an upper generally cylindrical elongate member and a lower generally cylindrical elongate member fixed in a position juxtaposed to the upper generally cylindrical elongate member.

The sides of the column assembly and the sides of the arm assembly present an aesthetically pleasing double cylinder design which is carried through other components of the assembly and which provides strength to the components.

Also, there is provided a display framework construction comprising at least one column including an elongate upwardly extending column assembly including at least a pair of generally cylindrical elongate members and a narrow elongate wall between said cylindrical elongate members, said wall including means for connecting additional components to said column.

DESCRIPTION OF THE PREFERRED EMBODIMENT

Figure 1:
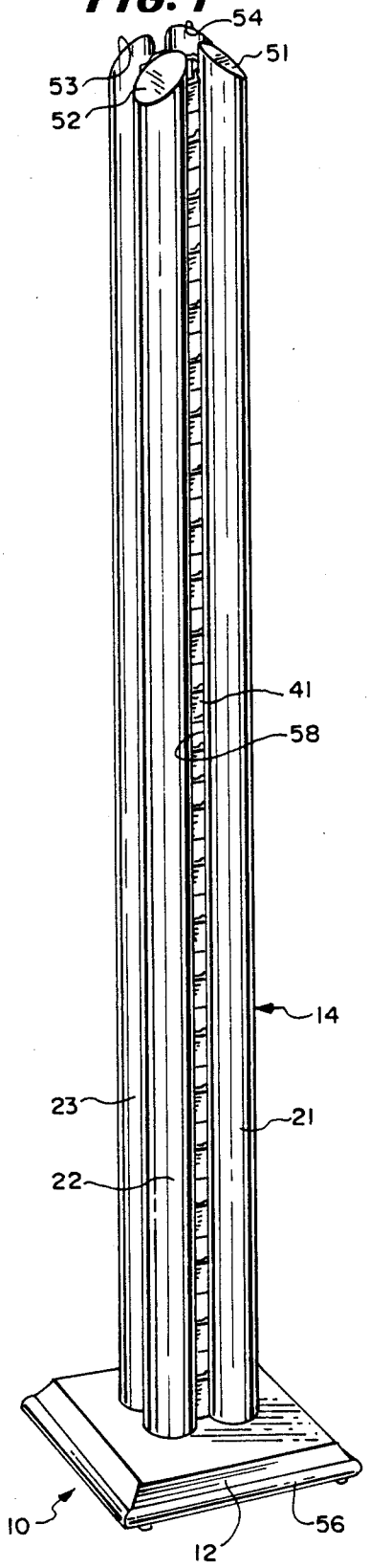
FIG. 1 is a perspective view of a column having a base and a column assembly including four elongate generally cylindrical members for a display framework construction which has a modular, double cylinder design according to the teachings of the present invention.

Referring to the drawings in greater detail, there is shown in FIG. 1 a perspective view of a display framework construction 10 comprising a column 11 including a rectangular or square base 12 and an elongate upstanding column assembly 14 comprising four elongate cylindrical members or tubes 21-24 arranged in a square configuration and an interior tubular member 26 having a generally + −shaped cross-section and having four narrow elongate walls 31–34 interconnected by four elongate walls 41–44, each having an arcuate, concave cross-section.

Each cylindrical member 21–24 is shown having an inclined upper surface 51–54, although such upper surface 51–54 can be generally horizontal for receiving and mounting other components of the display framework construction 10. The base 12 has at its bottom edge a rounded-in-cross section molding strip 56 which gives the appearance of a partially cylindrical member and adds to the aesthetic appearance of the column which includes the four cylindrical members 21–24.

Figure 2:
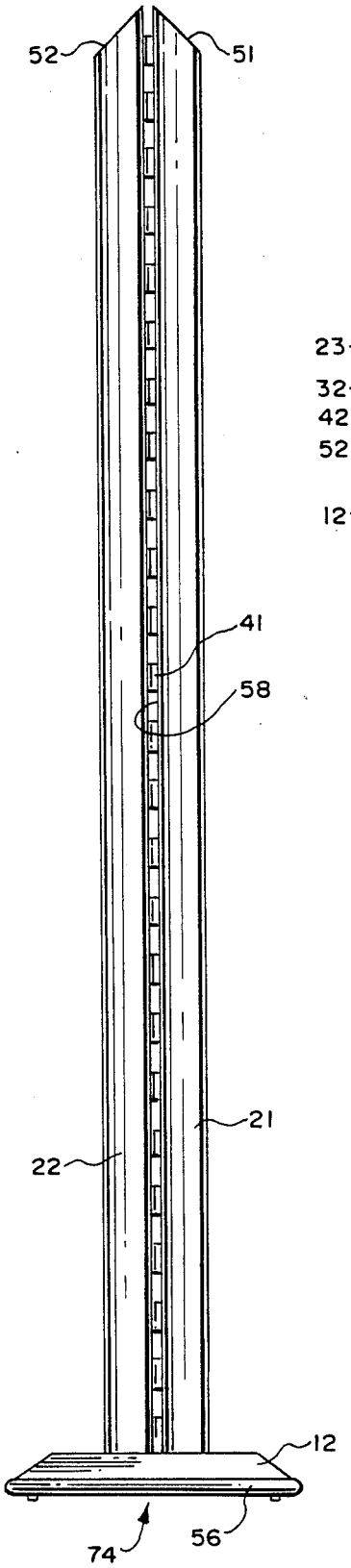
FIG. 2 is a side view of any one of the sides of the column shown in FIG. 1.
Figure 3:
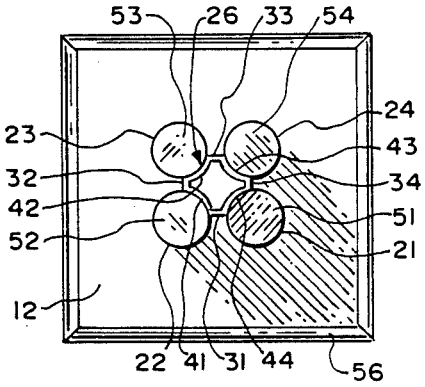
FIG. 3 is a top plan view of the column shown in FIG. 1.
Figure 4:
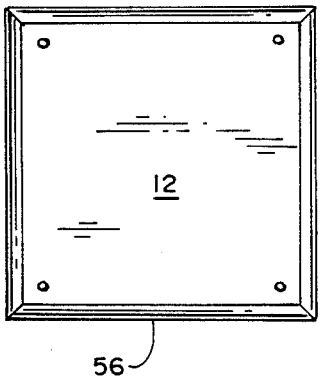
FIG. 4 is a bottom plan view of the column base shown in FIG. 1.

Each narrow elongate wall 31–34 of the interior tubular member 26 has a plurality of spaced apart holes or slots 58 therein, as shown in FIGS. 1 and 2, for receiving hooks 60 (FIGS. 8, 11 and 12) at the end of various components for creating different embodiments of the display framework construction of the present invention.

Figure 5:
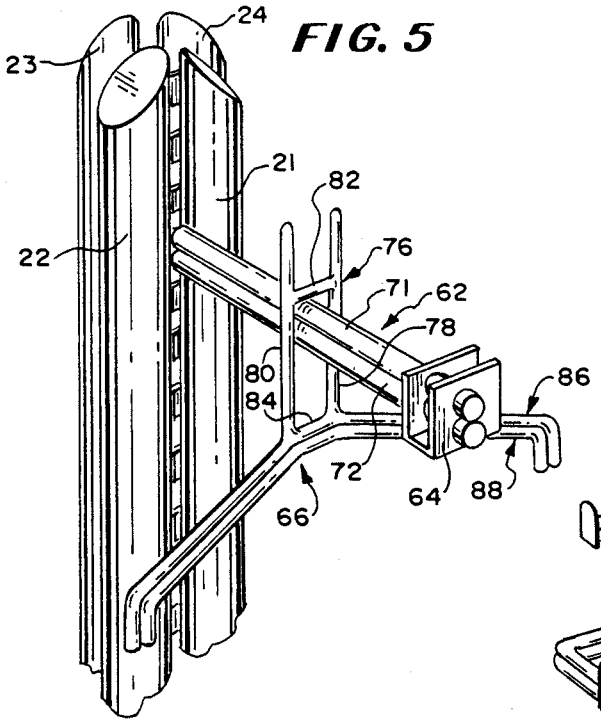
FIG. 5 is a fragmentary perspective view of the top portion of the column shown in FIG. 1 with a double cylinder arm extending therefrom and having a double rod clothes hanger depending therefrom in the display framework construction of the present invention.

For example, in FIG. 5 there is shown a double cylinder arm assembly 62 having a stop 64 at the end thereof and with a hanger 66 situated thereon and having a bracket 68 (FIG. 8) at the inner end thereof having two hooks 60 for mounting the bracket 68 to one of the elongate walls 31–34. The double cylinder arm assembly 62 includes an upper cylindrical rod member 71 and a lower cylindrical rod member 72 juxtaposed to each other to provide aesthetic continuity (a double cylinder appearance) consistent with the double cylinder profile of each side wall, e.g. side 74 shown in FIG. 2 of the column assembly 14.

The double cylinder rod members 71 and 72 provide additional strength to each arm assembly; e.g. arm assembly 62, as well as providing an aesthetically pleasing appearance.

The hanger 66 shown situated on the double cylinder arm assembly 62 has an H-shaped upper portion 76 including spaced apart cylindrical legs 78 and 80 and a cylindrical strut or cross member 82. A flat vertex 84 of a generally cylindrical V-shaped rod member 86 with rounded lower corners is fixed to the lower ends of the legs 78 and 80 and a similar lower generally cylindrical V-shaped rod 88 is fixed to and beneath the rod 86 so as to carry through the double cylinder member design of the display framework construction of the present invention in the hanger 66.

Figure 6:
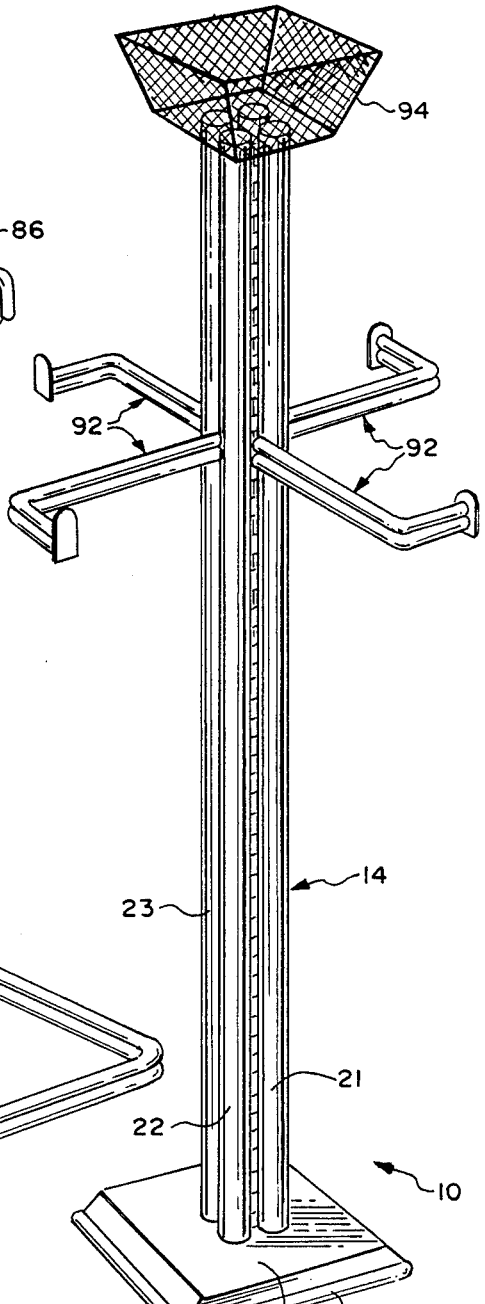
FIG. 6 is a perspective view of the column shown in FIG. 1 except that the top edge of each elongate cylindrical member is lying in a horizontal plane and supporting a decorative, inverted, frustum-shaped basket and shows four L-shaped double cylinder arms extending from the column so as to form a display framework including a swastika configuration of arms.

In FIG. 6 is shown another embodiment of a display framework construction 90 utilizing a column assembly 14 and four L-shaped double cylinder arm assemblies 92 mounted to respective ones of said narrow elongate walls 31–34 of the interior tubular member 26 at about the same height above a floor so as to present a swastika like configuration. These L-shaped arms are designed to receive hangers, like the hanger 66 shown in FIG. 5 with, of course, items of wearing apparel, e.g. coats, shirts, blouses, suits, situated on each hanger 66.

In this embodiment the cylindrical members 21–24 of the column assembly 14 have flat upper surfaces and an inverted decorative frustum shaped basket 94 is mounted on top of the upper surfaces of the cylindrical members 21–24. This display framework construction also includes a base 12 fixed to the bottom of the column assembly 14.

Figure 7:
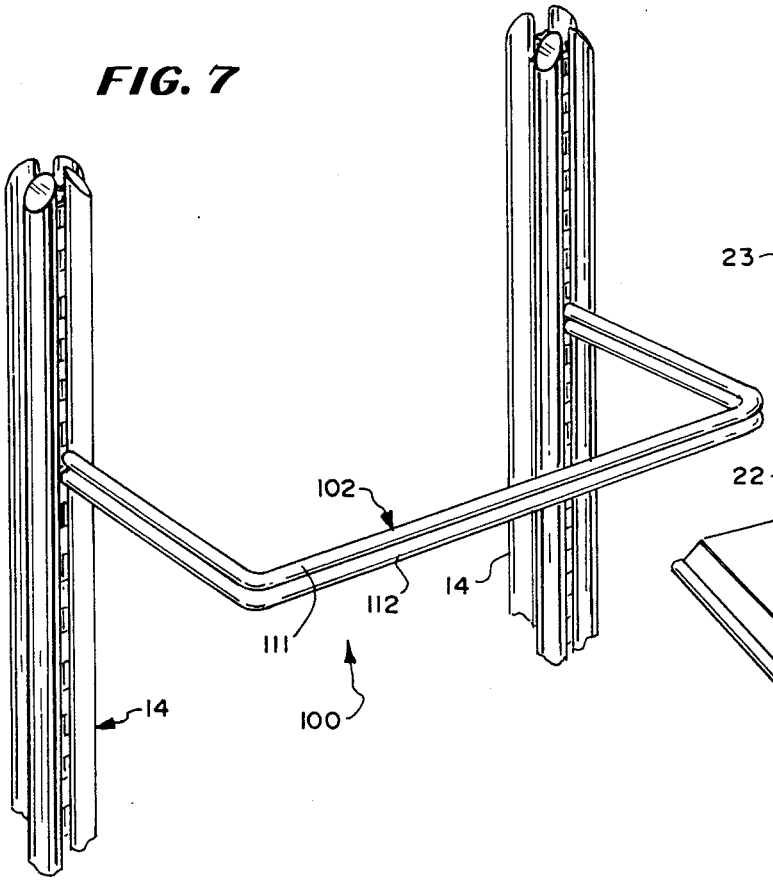
FIG. 7 is a perspective view of the upper portion of two columns as shown in FIG. 1 having a U-shaped double cylinder arm assembly extending between and mounted to both columns thereby to for another embodiment of the display framework construction.

In FIG. 7 there is shown still another embodiment of a display framework construction 100 constructed according to the teachings of the present invention. This display framework construction 100 includes two column assemblies 14 and a U-shaped double cylinder arm assembly 102 extending between and mounted between the two column assemblies 14. This double cylinder arm assembly 102 includes an upper U-shaped cylindrical member 111 and a lower cylindrical member 112 juxtaposed to and fixed to the upper cylindrical member 111. Brackets 68 (not shown) are provided on each end of the U-shaped double cylinder arm assembly 102 for mounting same to the respective column assemblies 14.

Figure 8:
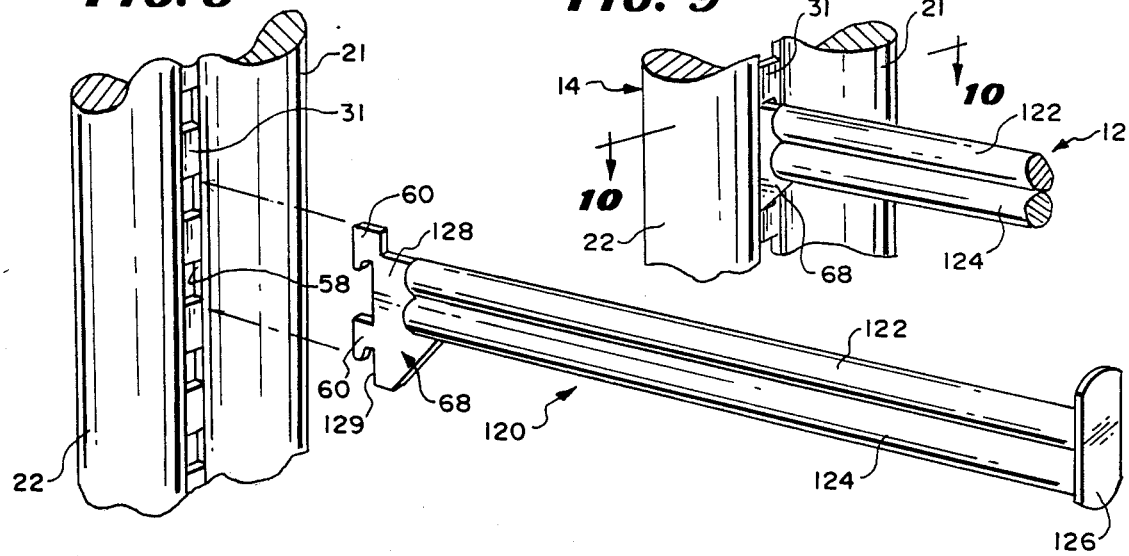
FIG. 8 is a fragmentary exploded perspective view of a portion of a column assembly showing spaced apart vertical holes in one vertical wall of an interior tubular member of the column assembly which are adapted to receive hooks of a bracket fixed to the inner end of a double cylinder arm.

FIG. 8 shows a straight double cylinder arm assembly 120 including an upper cylinder, rod or tube 122 and a lower cylinder rod or tube 124 juxtaposed to each other and having a stop member 126 fixed at and to the distal ends of the cylinder rods or tubes 122, 124 and a mounting bracket 68 fixed to the proximal ends of the cylinder, rods or tubes 122, 124. The mounting bracket 68 includes a plate 128 which has two spaced apart upper and lower hooks 60 along one side 129 thereof. Each hook 60 is adapted to be received in one of the holes or slots 58 in one of the narrow elongate walls 31–34 of the interior tubular member 26 of the column assembly 14.

Figure 9:
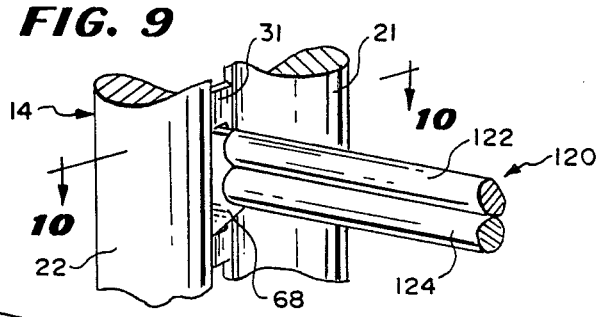
FIG. 9 is a fragmentary perspective view of the inner end of the double cylinder arm mounted to one wall of the inner tubular member of the column assembly.

FIG. 9 shows the double cylinder arm assembly 120 mounted to a column assembly 14 by reason of the hooks 60 of the bracket 68 being received in slots 58 in one of the narrow elongate walls 31–34.

Figure 10:
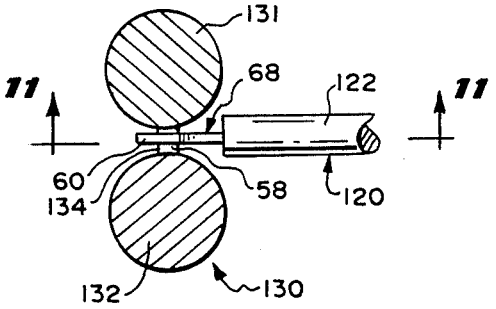
FIG. 10 is a horizontal sectional view taken along line 10—10 of FIG. 9.

In FIG. 10, there is illustrated a horizontal cross-section of a column assembly 130. Here, only two cylindrical members 131 and 132 are shown with a narrow elongate wall 134 therebetween. It is to be understood that either a column assembly 130 or a column assembly 14 can be used, as will be described below in connection with the description of FIGS. 8–11 and 16–18 where column assemblies 130 are used, or in connection with the description of FIGS. 1–3, 5–7 and 13–15 where column assemblies 14 are used.

Also, the cylindrical members 131 and 132 are shown in FIG. 10 as being solid, when in most instances such members will be hollow tubular members.

Figure 11:
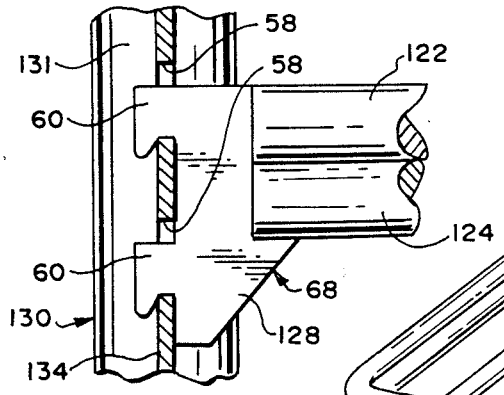
FIG. 11 is a fragmentary vertical sectional view taken along line 11—11 of FIG. 10.

FIG. 11 shows the hooks 60 of the bracket 68 received in the slots 58 of the wall 134 between the two cylindrical members 13 and 132.

Figure 12:
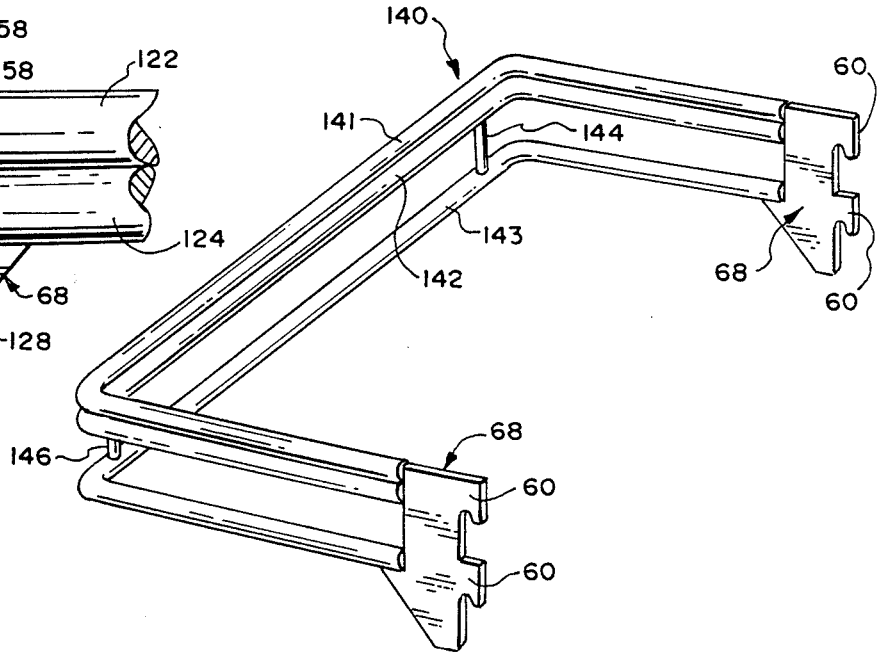
FIG. 12 is a perspective view of a U-shaped double cylinder arm assembly with an additional U-shaped tube or rod depending therefrom for receiving clothes hangers and shows end brackets of the U-shaped double cylinder arm assembly for mounting the U-shaped double cylinder arm assembly to and between two columns.

In FIG. 12, there is shown another embodiment of a U-shaped double cylinder arm assembly 140 which includes an upper generally U-shaped cylindrical member, tube or rod 141, a lower generally U-shaped cylindrical member, tube or rod 142 juxtaposed to and fixed to the upper member 141 and a third generally U-shaped cylindrical member, tube or rod 143 spaced below the lower member 141 and connected thereto by at least two struts 144 and 146. The cylindrical members 141, 142 and 143 can be solid rods or hollow tubes and have brackets 68 connected to the ends thereof.

Figure 13:
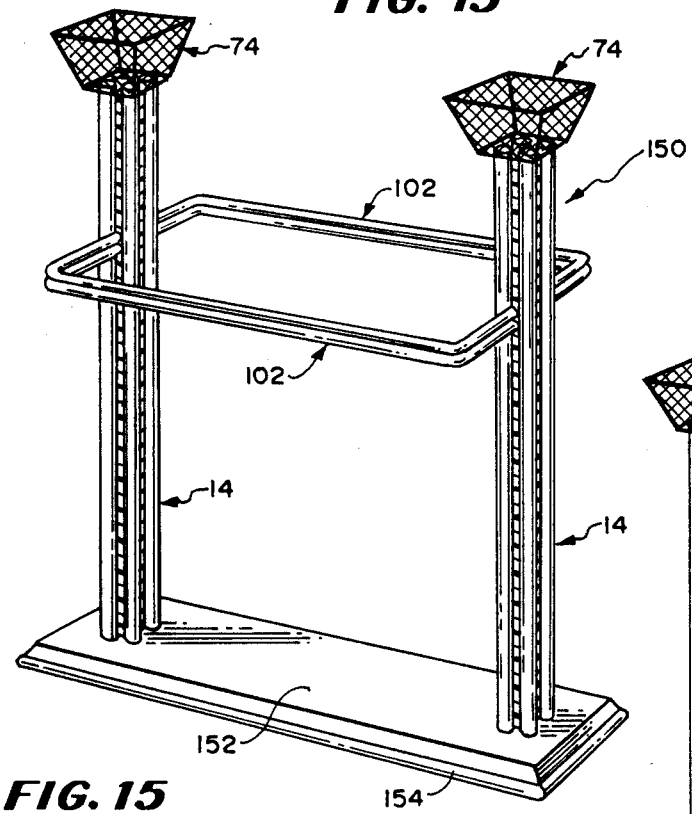
FIG. 13 is a perspective view of two columns as shown in FIG. 1 and two U-shaped double cylinder arm assemblies as shown in FIG. 7 mounted to and between the columns to form another embodiment of the display framework construction, the framework construction also including a rectangular base and baskets, as shown in FIG. 6, on top of each column.

In FIG. 13 there is shown another display framework construction 150 constructed according to the teachings of the present invention which includes two column assemblies 14 mounted on a rectangular base 152 having a lower rounded rail 154. Connected to and between the columns 14 are two U-shaped double cylinder arm assemblies 102 for receiving and holding clothes hangers thereon. The two double cylinder arm assemblies 102 form a general rectangular rail or rack for hanging clothes hangers with items of wearing apparel thereon.

The upper end of each of the column assemblies 14 has an inverted frustum shaped basket 74 thereon for decorative purposes.

Figure 14:
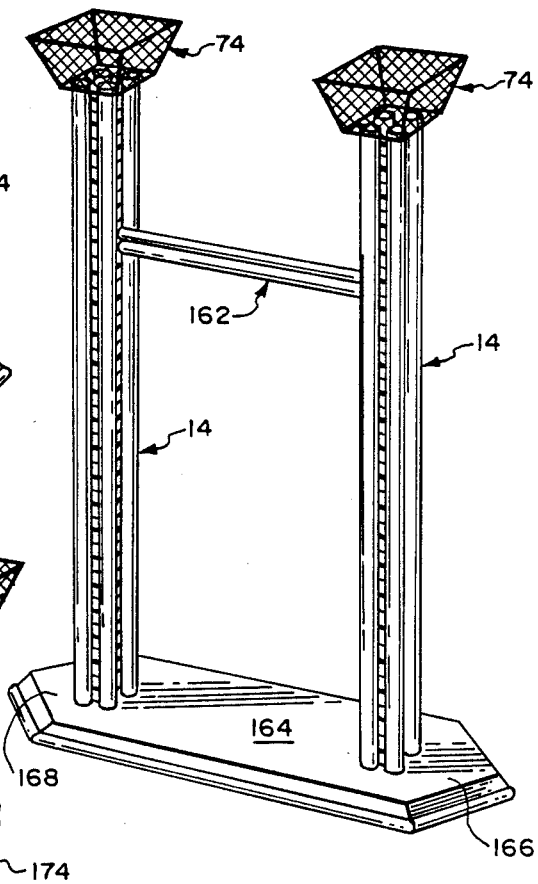
FIG. 14 is a perspective view of another embodiment of a display framework construction including two columns, as shown in FIG. 1, a base with V-shaped ends, a straight double cylinder arm that extends between and is mounted to the two columns and a basket, as shown in FIG. 6, on the top of each column.

FIG. 14 shows another embodiment of a display framework construction 160 constructed according to the teachings of the present invention wherein a single straight double rod or tube arm assembly 162 is fixed to and between two column assemblies 14.

Each column assembly 14 has an inverted frustum shaped basket 94 mounted to the top thereof. Also, the column assemblies are fixed to a generally rectangular base member 164 having V-shaped end portions 166 and 168.

Figure 15:
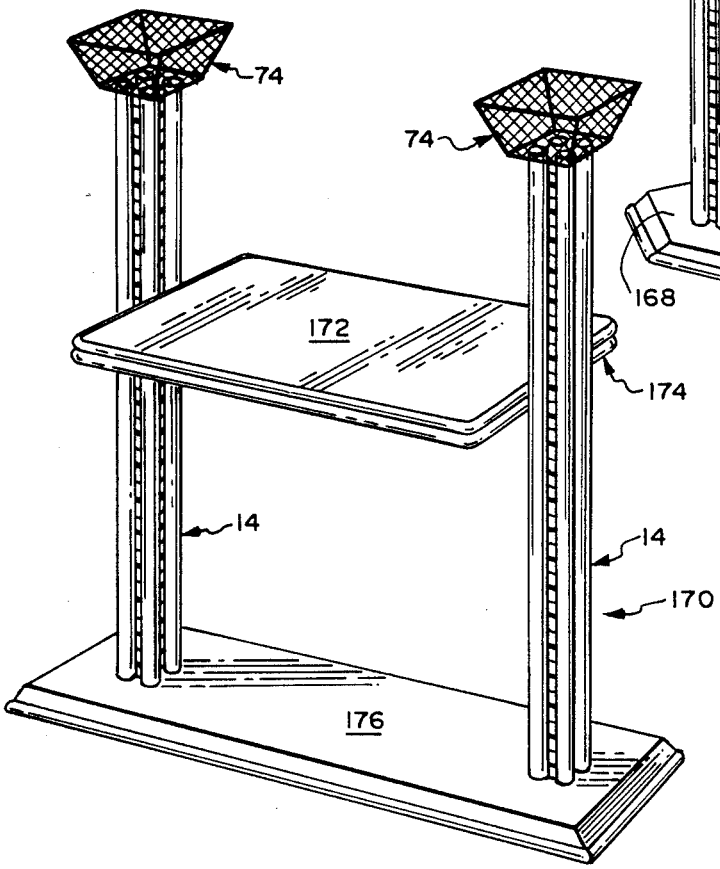
FIG. 15 /is a perspective view of another embodiment of the display framework construction, similar to the view shown in FIG. 13 except with a tray or table having a double cylinder border extending between and mounted to the columns, in place of the two U-shaped double cylinder arm assemblies shown in FIG. 13.

FIG. 15 is a perspective view of still another display framework construction 170 constructed according to the teachings of the present invention wherein a table or shelf 172 having a double rod or tube edge formation 174 thereon is fixed to and between two column assemblies 14. Each column assembly 14 has an inverted frustum shaped basket 74 mounted to the top thereof. Both column assemblies 14 are mounted to a rectangular base 176 similar to the rectangular base 152 shown in FIG. 13.

Figure 16:
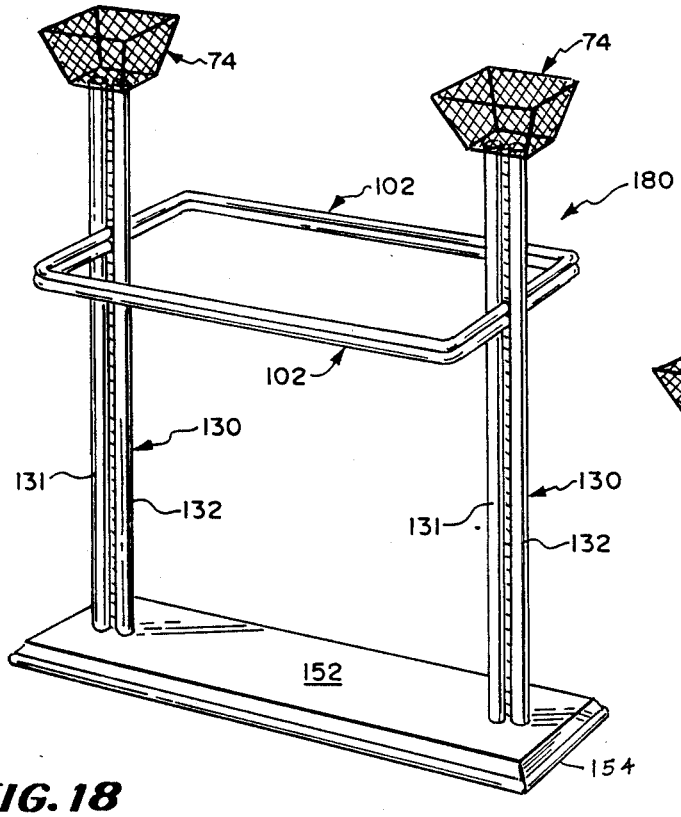
FIG. 16 is a perspective view of another embodiment of the display framework construction of the present invention, similar to the embodiment shown in FIG. 13, but wherein each column includes only two cylindrical members and two U-shaped double cylinder arm assemblies as shown in FIGS. 7 and 13 mounted to and between the columns to form a display framework construction that includes a rectangular base and baskets, as shown in FIG. 6, on top of each column, and with the cylindrical members of both columns lying in the same plane.

FIG. 16 shows a display framework construction 180 similar to the display framework construction 150 shown in FIG. 13, except that column assemblies 130 comprising only two elongate rods or tubes 131 and 132 are used where each rod or tube 131, 132 of each assembly 130 lies in the same plane.

Figure 17:
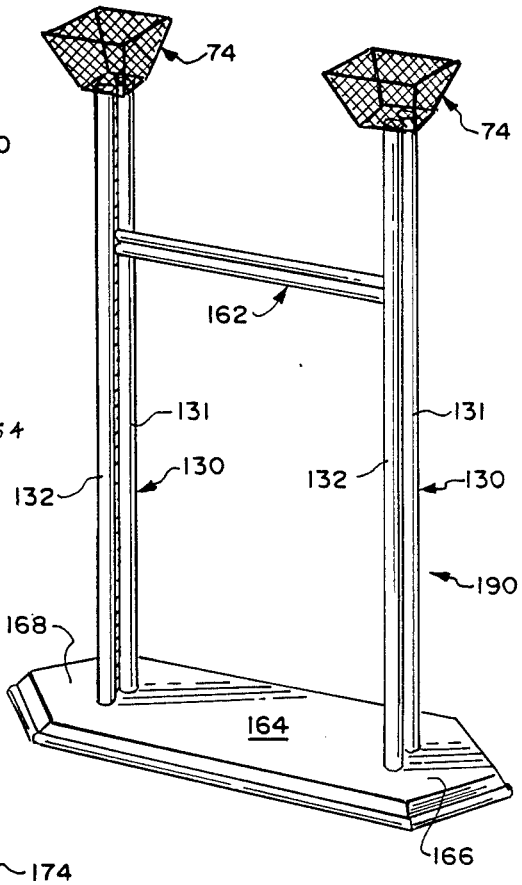
FIG. 17 is a perspective view of another embodiment of the display framework construction, similar to the embodiment shown in FIG. 14, but wherein each column includes only two cylindrical members and an elongate double cylinder arm therebetween, with the cylindrical members in one column lying in a plane which is parallel to the plane containing the cylindrical members of the other column.

FIG. 17 shows a display framework construction 190 similar to the display framework construction 160 shown in FIG. 14, except, here again, column assemblies 130 are used. In this embodiment, the rods or tubes 131, 132 of one column assembly 130 lie in a plane which is parallel to the plane containing the rods or tubes 131,132 of the other column assembly 130.

Figure 18:
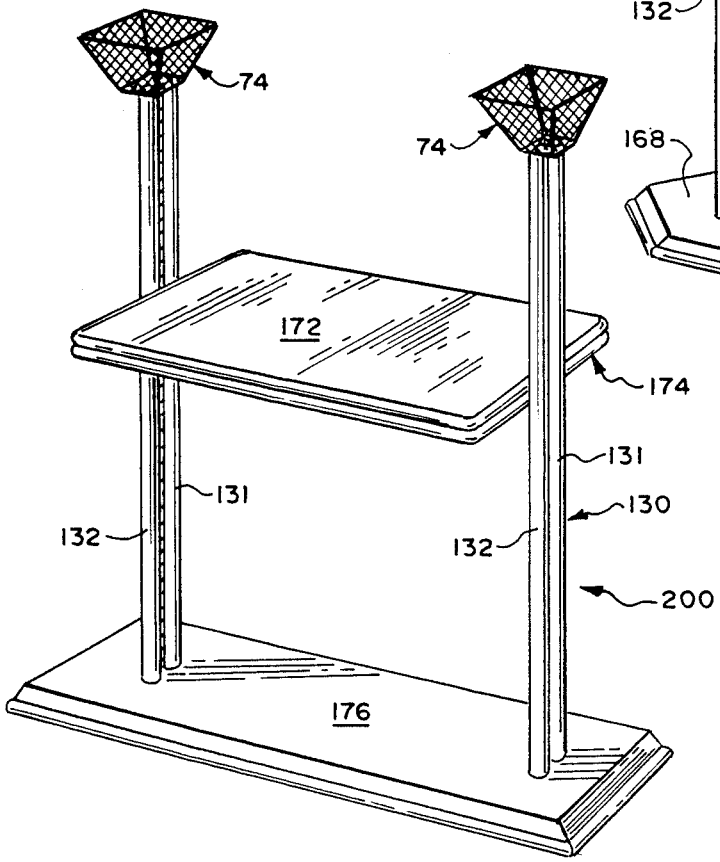
FIG. 18 is a perspective view of a further embodiment of the display framework construction, similar to the embodiment shown in FIG. 15, but wherein each column includes only two cylindrical members with the cylindrical members in one column lying in a plane which is parallel to a plane containing the cylindrical members of the other column.

FIG. 18 shows a display framework construction 200 similar to the display framework construction 170 shown in FIG. 15, except, here again column assemblies 130 are used with the rods or tubes 131, 132 of one column assembly 130 being situated in a plane which is parallel to a plane containing the rods or tubes 131, 132 of the other assembly 130.

Figure 19:
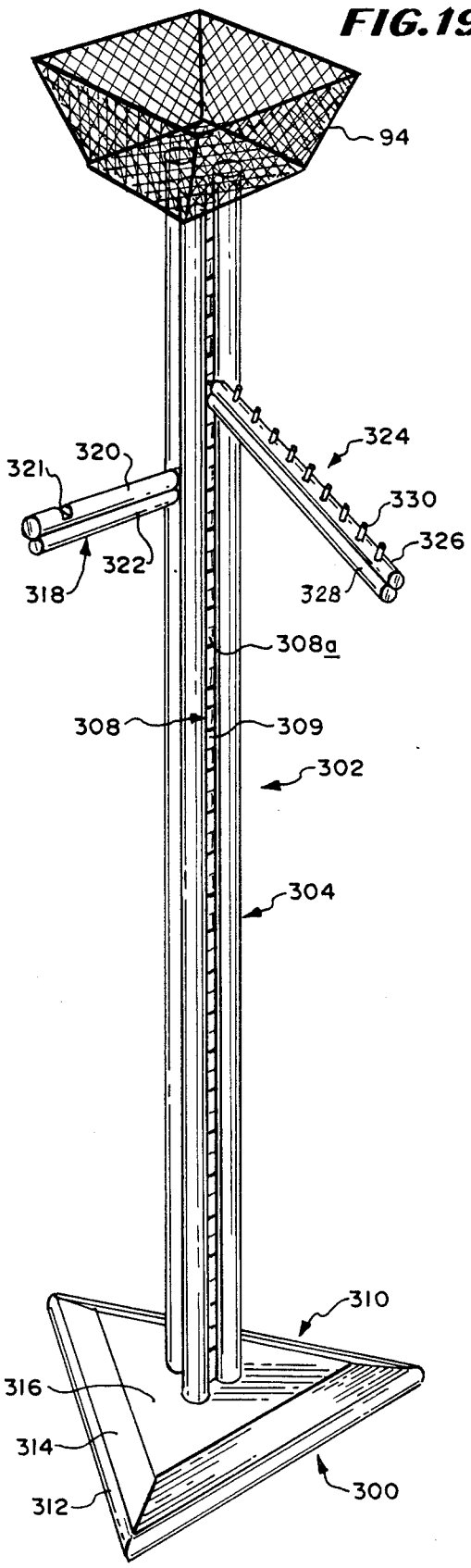
FIG. 19 is a perspective view of another embodiment of a display framework of the present invention and includes a column comprising three cylindrical members mounted on a triangular base and having a basket, as shown in FIG. 6, on top of the column and having two embodiments of double tube or rod arms extending therefrom, one arm being a short arm and comprising a notch in the upper tube or rod thereof, and the other arm being an arm which is inclined downwardly from a bracket (not shown) mounting it to the column and having pegs extending from the upper rod or tube thereof for catching hangers.

FIG. 19 is a perspective view of still another embodiment of a display framework 300 constructed in accordance with the teachings of the invention. Here there is provided a column 302 including a column assembly 304 which includes three generally elongate cylindrical members 306 arranged in a triangular configuration around an interim hollow tubular member 308. The hollow tubular member 308 has a generally triangular cross-section on three narrow elongate walls, one of which, 308*a* is shown, each having slots 309 therein.

The column assembly 304 is mounted on top of a triangular base 310 which has a bottom rib 312 along each side thereof, the rib 312 being partially circular in cross-section. The remainder of the base 310 has inclined surfaces 314 extending upwardly from each bottom rib 312 to an upper planar surface 316. The column assembly is mounted to and extends upwardly from this upper planar surface 316.

On top of the column assembly 304 is a basket 94 of the type shown in FIG. 6.

In this embodiment of a display framework 300 there is also shown another embodiment of a double tube or rod arm assembly 318 which includes a short upper rod, cylinder or tube 320 and a short lower rod, cylinder or tube 322, fixed to the upper rod. This arm assembly 318 includes a bracket (not shown) at the inner end thereof for mounting the arm assembly 318 to the column assembly 304. As shown, the upper rod, cylinder or tube 320 of the arm assembly 304 has a notch 321 therein for receiving a hanger.

Further, the display framework 300 includes another embodiment of a double tube or rod arm assembly 324 which includes an upper rod, cylinder or tube 326 and a lower rod, cylinder or tube 328 fixed beneath and to the upper rod, cylinder or tube 326 and, at the inner end thereof hidden from view, a bracket, similar to the bracket 68, for mounting the arm assembly to the column assembly 304. The upper and lower cylinders, rods or tubes 326 and 328 which are fixed together extend angularly downwardly from the bracket (not shown) and the upper rod, cylinder or tube 326 has a plurality of spaced apart pins or pegs 330 extending from the upper surface thereof for catching hangers which are positioned thereon.

Figure 20:
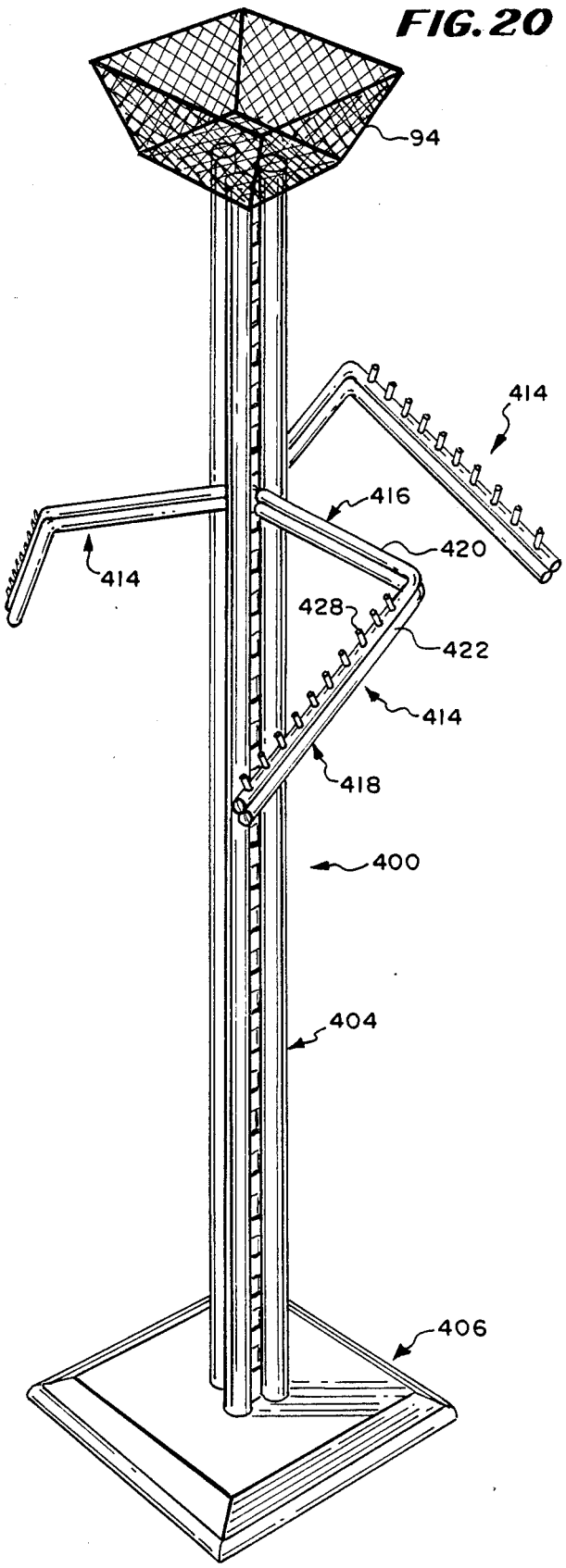
FIG. 20 is a perspective view of a further embodiment of the display framework of the present invention and comprises a column having three cylindrical elongate members mounted on a square base with a basket, as shown in FIG. 6, mounted on the top of the column and having three L-shaped angled double rod or tube arms extending therefrom, each L-shaped arm including a bracket (not shown) for mounting the arm to the column, a first generally horizontally extending portion extending outwardly from the column, and a second portion which is bent from the first rod portion to form an L in intersecting vertical planes and bent to extend downwardly from the first portion of the arm, the upper rod or tube of the second portion of the double rod or tube arm having pins thereon for catching hangers for holding clothing.

FIG. 20 is a perspective view of still another embodiment of a display framework 400 constructed according to the teachings of the present invention. In this embodiment of the display framework 400, a three cylinder column assembly 404 similar to column assembly 304 shown in FIG. 19 is mounted on a generally square base 406 having a rib 408 extending along each side of the base 408, the rib 408 being partially circular in cross-section. The base 406 then has inclined side surfaces 410 extending upwardly from each rib to an upper, generally square flat planar surface 412. The three cylinder column assembly 404 is mounted to this upper flat surface 412 and extends upwardly therefrom.

A basket 94, of the type shown in FIG. 6, is mounted to the upper end of the column assembly 404.

In this embodiment, the column assembly 404 has mounted thereon three L-shaped angularly inclined arm assemblies 414. Each arm assembly 414 has a bracket (not shown), similar to bracket 68 shown in FIG. 8, connected to the inner end thereof, an inner arm portion 416 and an outer arm portion 418. Each arm portion 416 and 41 includes an upper rod or tube 420, and a lower rod or tube 422 attached to the underside of the upper rod or tube 420. The inner arm portion 416 extends generally horizontally outwardly from the bracket connected to the column assembly 404 to a corner 424 where the upper and lower rods 420 and 422 are bent in two directions, a first direction to form a generally L configuration and then downwardly in a second direction to place the outer arm portion 418 at an angle to the horizontal. The outer arm portion 418 lines in a vertical plane that is generally 90° to the plane of the inner arm portion 416 and extends angularly downwardly from the horizontal plane of the inner arm portion 416. The upper surface of the upper rod, cylinder or tube 420 of the outer arm portion 418 of the arm assembly 414 has a plurality of spaced apart pegs or pins 428 thereon extending generally vertically upwardly therefrom and disposed to receive and catch hangers that may be hung therefrom, which may be of the type shown in FIG.

Figure 21:
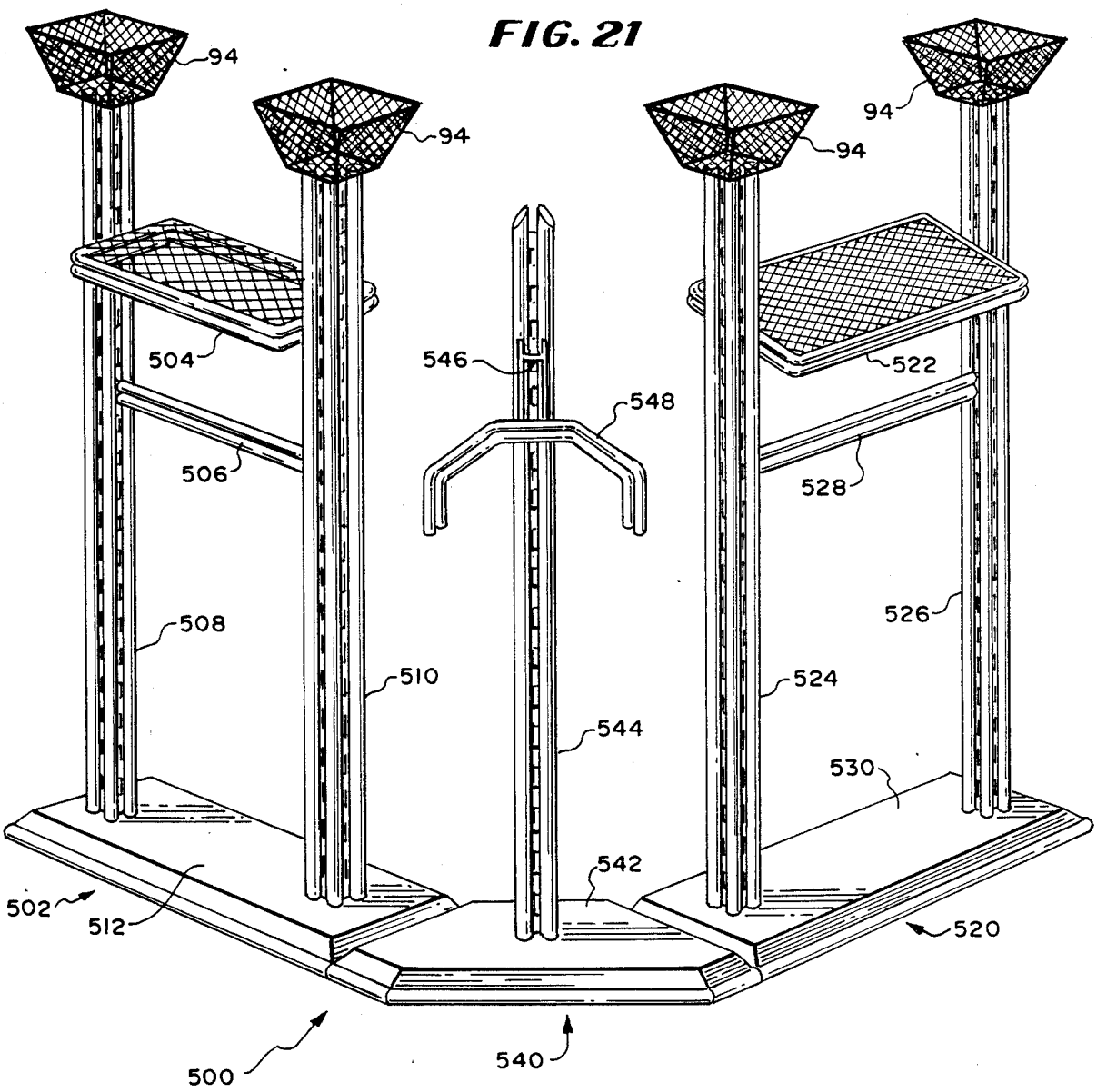
FIG. 21 is a perspective view of three embodiments of the display framework of the present invention assembled into a modular display unit with a left hand framework being a composite of FIGS. 13 and 14 with a straight shelf and a straight arm extending between two columns on a rectangular base, a right hand framework similar to the left hand framework but including an inclined or slant shelf and a double rod or tube arm extending between two four cylinder columns and a middle framework including a two or three cylinder column on a truncated triangular base and shows a hanger, as shown in FIG. 5, hanging from a short arm.

In FIG. 21 there is illustrated a display framework assembly or unit 500 of three display framework constructions of the present invention, some of which have been illustrated previously, including a first display framework construction 502 shown on the right hand side of FIG. 21 which includes a straight shelf 504 and a double and straight arm assembly 506 extending between two column assemblies 508 and 510 mounted on and extending upwardly from a rectangular base 512. Each column assembly 508 and 51O has a basket 94 on the top thereof, similar to the basket 94 shown in FIG. 6.

Then, on the right hand side of FIG. 21, there is shown another display framework construction 520 including a table or shelf 522 positioned at an angle and mounted to and between two column assemblies 524 and 526 which also have a double rod straight arm assembly 528 extending therebetween and has a basket 94 thereon. The two column assemblies 524 and 526 are mounted on a rectangular base 530. The framework construction 500 and the framework construction 520 are situated at 90° from each other and spaced from each other.

A third display framework construction 540 having a generally triangular base 542 with corner portions cut away is positioned between the two framework constructions 502 and 520 so as to form the modular assembly 500. This middle display framework construction 540 includes a two or three cylinder column assembly 544 mounted to and extending upwardly from the base 542, and is shown with the tops of the columns cut at an angle as in the embodiment shown in FIG. 1. Also, there is shown a short arm 546 extending outwardly therefrom and having a hanger 548 depending therefrom.

The modular assembly or unit 500 shown in FIG. 21 illustrates how various embodiments of the display framework construction can be assembled to form an aesthetically pleasing appearing and modular functioning assembly.

From the foregoing description, it will be apparent that the various components of the display framework constructions of the present invention, including the various display frameworks constructed from these components, have a number of advantages some of which have been described above and others of which are inherent in the display framework construction of the present invention. In this respect, the double tube or rod construction of the components for the display framework construction are both functional and ornamental.

I claim:

1. A display framework construction comprising at least one column including a base and an elongate upwardly extending column assembly including four generally cylindrical elongate members, each generally cylindrical member being located at a corner of the column assembly and an interior elongate tubular member having a generally +−shaped cross-section with four narrow elongate walls interconnected by four elongate walls each having an arcuate, concave cross-section, each of said narrow elongate wall being positioned between respective pairs of said generally cylindrical member, each said narrow elongate wall having a plurality of connection means for detachably securing additional components to said column at different heights, each said connection means including an opening in said respective wall.

2. The display framework construction of claim 1 wherein said cylindrical members are hollow tubular members to provide lightweight strength to the column assembly.

3. The display framework construction of claim 1 wherein said connection means in each of said elongate narrow walls of said interior tubular member comprises a plurality of vertically spaced apart slots therein for receiving hooks on brackets for creating different display framework constructions.

4. The display framework construction of claim 1 further including an inverted decorative frustum shaped basket like member on top of said column.

5. The display framework construction of claim 1 including at least one specially configured arm assembly, said arm assembly comprising an upper generally cylindrical elongate member and a lower generally cylindrical elongate member fixed in a position juxtaposed to the upper generally cylindrical elongate member, a bracket fixed to one end of said arm assembly, each said connection means in each of said elongate narrow walls comprising at least two adjacent slots, said bracket including two spaced apart hooks which are adapted to be received in said two adjacent slots in one of said elongate narrow walls of said interior tubular member for releasably mounting arm assembly to said column member.

6. The display framework construction of claim 5 wherein said arm assembly has a stop at the distal end thereof for keeping a hanger from sliding off of said arm assembly.

7. The display framework construction of claim 5 wherein said arm assembly has a lateral bend therein so as to provide the arm assembly with a generally L shape.

8. The display framework construction of claim 7 including three additional arm assemblies mounted to said column in an arrangement which defines a swastika configuration.

9. The display framework construction of claim 5 including a second column assembly mounted on a base and wherein said arm assembly has a bracket at each end thereof such that said arm assembly can be mounted between said two column assemblies.

10. The display framework construction of claim 5 including at least one specially configured hanger including a generally H-shaped upper portion comprising spaced apart generally cylindrical vertically extending legs, a generally cylindrical horizontally extending strut between said legs, a first, generally cylindrical, inverted V-shaped rod having the vertex thereof situated between and connected to the lower ends of the legs of said H-shaped portion and a second, generally cylindrical, inverted V-shaped rod fixed to and beneath said first rod, said first and second inverted V-shaped rods having rounded shoulders at each end thereof so as to have the shape of a hanger.

11. The display framework construction of claim 1 including a second column assembly and at least one U-shaped arm assembly having upper and lower elongate generally cylindrical members or bars juxtaposed to each other and each having a mounting bracket at each end of said upper and lower U-shaped generally cylindrical elongate members or bars, each bracket having two hooks thereon for mounting to said connection means and extending between said two column assemblies.

12. The display framework construction of claim 11 wherein said U-shaped arm assembly includes a third generally cylindrically shaped bar or tube which extends below and depends from said second lower, generally cylindrical, U-shaped bar of said arm assembly between the brackets at each end of said arm assembly.

13. The display framework construction of claim 11 including a second U-shaped arm assembly mounted to said two column assemblies opposite said first U-shaped arm assembly.

14. The display framework construction of claim 1 including a second column assembly and a rectangular shelf extending between and connected to the column assemblies and having a double cylindrical bar formation including elongate, at least partially cylindrical, upper and lower bars or tubes juxtaposed to each other.

15. A display framework assembly including a display framework construction as claimed in claim 1 in combination with a display framework construction comprising at least one column including a base and an elongate upwardly extending column assembly comprising two generally cylindrical elongate members and a bar extending therebetween and having slots therein for receiving and mounting a bracket of an arm assembly.

16. A display framework assembly including the display framework construction as claimed in claim 1 and at least one other display framework construction comprising at least one column including a base and an elongate upwardly extending column assembly including three generally cylindrical elongate members and an interior elongate hollow tubular member having a generally triangular cross-section and three narrow elongate walls with slots therein each disposed between adjacent two of the generally cylindrical elongate members.

17. The display framework assembly of claim 16 wherein said second display framework construction has a generally triangular base and said assembly includes a further display framework construction as defined in claim 1.

18. The display framework construction of claim 1 including a short arm assembly comprising a mounting bracket at the inner end thereof for mounting the arm assembly to said connection means of the column assembly, an upper rod and a lower rod fixed to and beneath the upper rod and said upper rod having a notch therein for receiving a hanger.

19. The display framework construction of claim 1 including an arm assembly comprising a mounting bracket at the inner end thereof for mounting the arm assembly to said connection means of the column assembly, an upper rod inclined downwardly from said bracket, a lower rod beneath and fixed to said upper rod and a plurality of spaced apart pegs on and extending upwardly from the upper surface of said upper rod.

20. The display framework construction of claim 1 including at least one angled generally L-shaped arm assembly including an inner arm portion and an outer arm portion, a mounting bracket at the inner end of said inner arm portion for mounting the arm assembly to said connection means of the column assembly, aid arm assembly including in each portion thereof an upper rod and a lower rod fixed to and beneath the upper rod, said inner arm portion extending generally horizontally outwardly from said mounting bracket and said outer arm portion extending at approximately, a right angle from said inner arm portion and angularly downwardly, the upper surface of said upper rod in said outer arm portion having spaced apart pegs on and extending upwardly therefrom.

21. The display framework construction of claim 1 further comprising at least one additional column including an elongate upwardly extending column assembly including at least a pair of generally cylindrical elongate members and a narrow elongate wall between said cylindrical elongate members, said wall including means for connecting additional components to said column.

22. The construction of claim 21 in which the additional column assembly includes three generally cylindrical elongate members each connected to an adjacent member by a respective narrow elongate wall.

23. The construction of claim 21 in which the elongate narrow walls have a plurality of vertically spaced-apart slots for creating different framework constructions, and an arm assembly comprising a bracket fixed to one end of said arm assembly, said bracket including two spaced-apart hooks which are adapted to be received in two of said slots for releasably mounting said arm assembly to said column assembly.

* * * * *

UNITED STATES PATENT AND TRADEMARK OFFICE

CERTIFICATE OF CORRECTION

PATENT NO. : 4,932,539

DATED : June 12, 1990

INVENTOR(S) : SHARON M. ABINANTI

It is certified that error appears in the above-identified patent and that said Letters Patent is hereby corrected as shown below:

Column 3, line 10, "FIG.15/is" should be --FIG. 15 is--.

Column 11, line 3, "aid" should be --said--.

Signed and Sealed this

Eighth Day of December, 1992

*Attest:*

DOUGLAS B. COMER

*Attesting Officer*

*Acting Commissioner of Patents and Trademarks*